US008955698B2

(12) United States Patent
Hsieh

(10) Patent No.: US 8,955,698 B2
(45) Date of Patent: Feb. 17, 2015

(54) TOOL RETAINING PLATE

(71) Applicant: Chih-Chien Hsieh, Taichung (TW)

(72) Inventor: Chih-Chien Hsieh, Taichung (TW)

( * ) Notice: Subject to any disclaimer, the term of this patent is extended or adjusted under 35 U.S.C. 154(b) by 96 days.

(21) Appl. No.: 13/861,626

(22) Filed: Apr. 12, 2013

(65) Prior Publication Data

US 2014/0305824 A1 Oct. 16, 2014

(51) Int. Cl.

| | |
|---|---|
| ***A47F 7/00*** | (2006.01) |
| ***B25H 3/04*** | (2006.01) |
| ***B25H 3/00*** | (2006.01) |

(52) U.S. Cl.

CPC ..... *B25H 3/04* (2013.01); *A47F 7/0028* (2013.01); *B25H 3/003* (2013.01)

USPC ..... 211/70.6; 206/378

(58) Field of Classification Search

CPC ..... A45C 11/26; A45C 13/04; B25H 3/00; B25H 3/04; B25H 3/06; B25H 3/02; B25H 3/003; B47F 7/0028; B47F 7/0035; B47F 7/0021; B25B 13/56

USPC ..... 211/70.6, 69; 206/378, 372, 373, 374, 206/376, 377, 379

See application file for complete search history.

(56) References Cited

U.S. PATENT DOCUMENTS

| | | | | | |
|---|---|---|---|---|---|
| 5,467,874 | A * | 11/1995 | Whitaker | ..... | 206/378 |
| 6,070,745 | A * | 6/2000 | Dembicks | ..... | 211/70.6 |
| 6,092,655 | A * | 7/2000 | Ernst | ..... | 206/378 |
| 6,386,363 | B1 * | 5/2002 | Huang | ..... | 206/378 |
| 6,474,481 | B1 * | 11/2002 | Liu | ..... | 211/69 |
| 6,494,329 | B1 * | 12/2002 | Dembicks | ..... | 211/70.6 |
| 8,770,418 | B2 * | 7/2014 | Ernst | ..... | 211/70.6 |
| 2011/0089126 | A1 * | 4/2011 | Hsieh | ..... | 211/70.6 |
| 2013/0186243 | A1 * | 7/2013 | Harper et al. | ..... | 81/180.1 |

* cited by examiner

*Primary Examiner* — Jennifer E Novosad
(74) *Attorney, Agent, or Firm* — Egbert Law Offices, PLLC

(57) ABSTRACT

A tool retaining plate has a disc base with a holding surface and a mounting surface. Sets of sleeving columns are configured at interval on the mounting surface and are of an octagonal columnar pattern to define a column head end, a column foot end and a circumferential portion. Four abutting surfaces and four locking surfaces are cross connected at the circumferential portion, and an angular locking portion is formed between the abutting surface and locking surface. Positioning bulges are protruded externally onto two opposite abutting surfaces of the circumferential portion of the sleeving column, opposite to the positioning flanges of the sleeve. This enables engagement with the positioning flanges on the slot wall of the square slot of the sleeve. Two locking portions configured diagonally and set adjacent to the abutting surface with positioning bulges are set into a notched pattern or offset towards the abutting surface.

6 Claims, 7 Drawing Sheets

TOOL RETAINING PLATE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a tool retaining plate, and more particularly to an innovative one which is used for positioning sleeves.

2. Description of Related Art Including Information Disclosed Under 37 CFR 1.97 and 37 CFR 1.98

Common sleeves in idle state are assembled securely onto a permanent seat of a tool for orderly placement and fixation. Said permanent seat of a tool is structurally designed in a way that a square or round column is protruded on said seat for sleeving into the square slot of an existing sleeve, and the sleeve could be easily positioned due to appropriate mating with the square slot. However, the following shortcomings are observed during actual applications.

As for a round column, when sleeving into the square slot of the sleeve, there are only four contact points left between the cylinder and square slot, making it hard for tight mating, and leading to the problems of looseness or instability. As for a square column, it is hard to control the mating tightness of the square column of the permanent seat with the square slot of the sleeve, so any dimensional error will affect the tightness of sleeve assembly. In the case of too tight mating, it is inconvenient for the users to take or position the sleeve. Otherwise, the sleeving state of the sleeve is unstable, making it vulnerable to looseness and disengagement.

Thus, to overcome the aforementioned problems of the prior art, it would be an advancement if the art to provide an improved structure that can significantly improve the efficacy.

Therefore, the inventor has provided the present invention of practicability after deliberate design and evaluation based on years of experience in the production, development and design of related products.

BRIEF SUMMARY OF THE INVENTION

The tool retaining plate disclosed in the present invention comprises of two locking portions configured diagonally and set adjacent to the abutting surface with positioning bulges are set into a notched pattern or offset towards the abutting surface, forming a crossing space between the slot wall of the sleeve and the notched or offset locking portions, thus greatly reducing the friction area and resistance, and realizing easier and smooth rotation and locking of the sleeve.

In addition, said tool retaining plate, in comparison to prior art, has a space between the square slot of the sleeve and sleeving columns allowing for a wider range of compatibility errors, thus providing the advantages of simple structure and easy fabrication. Said design does not affect the stability of the sleeve positioning, can allow smooth accessibility and assembly capability, and enhance the stability and convenience of the sleeve positioning.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
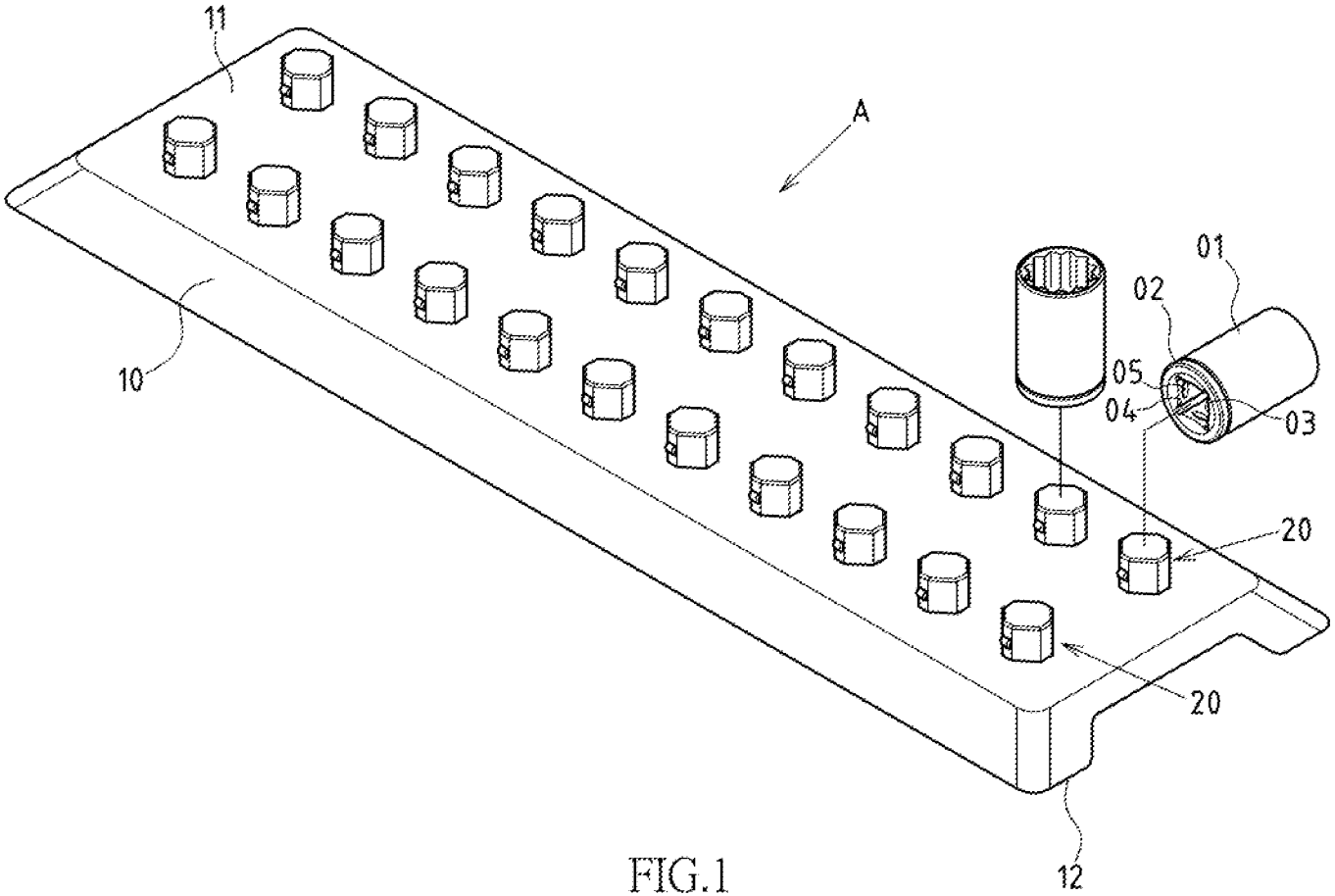
FIG. 1 is a perspective view of the preferred embodiment of the present invention.
Figure 2:
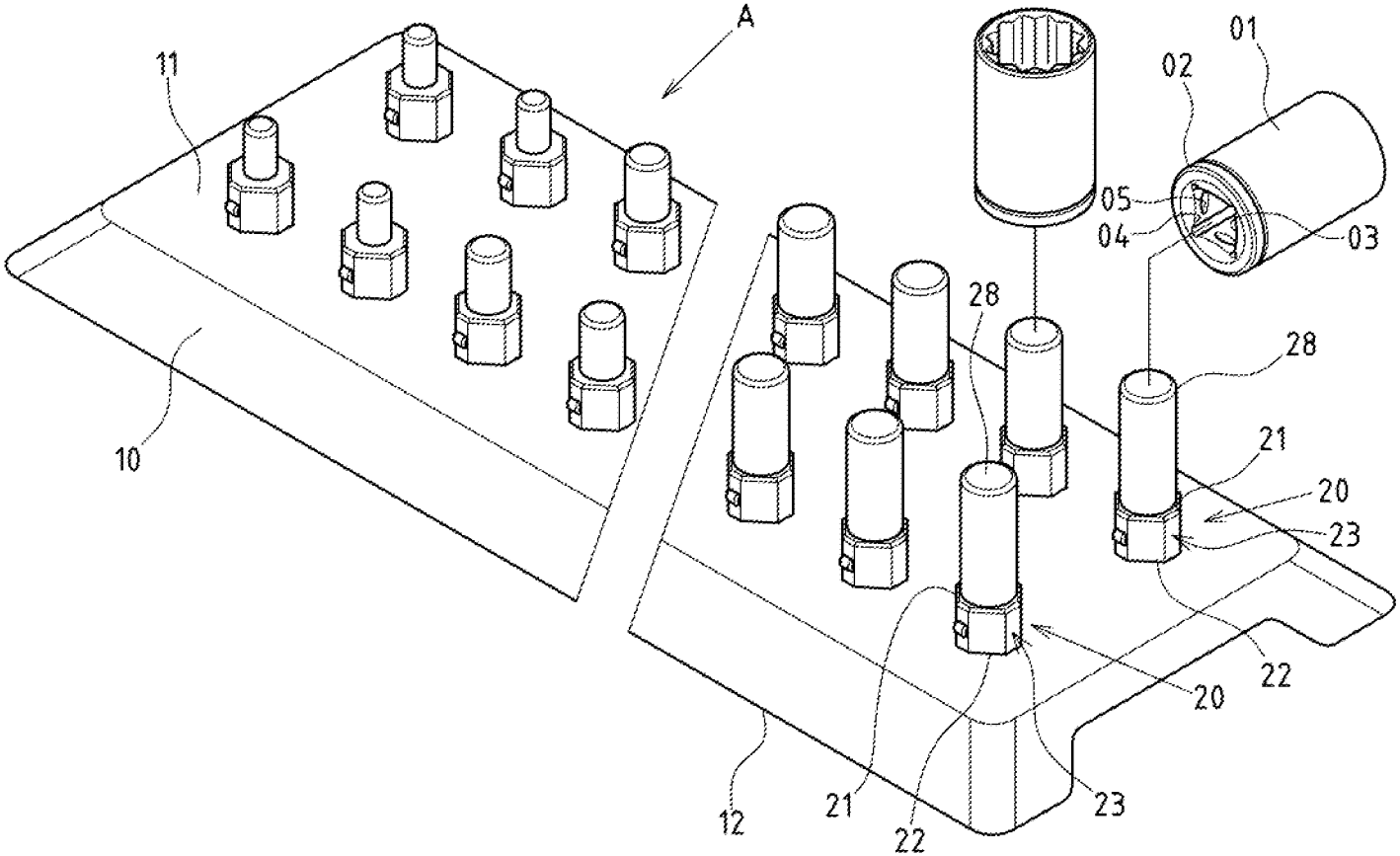
FIG. 2 is a perspective view of the present invention wherein an extension rod is connected at top of the sleeving column of the sleeve.
Figure 3:
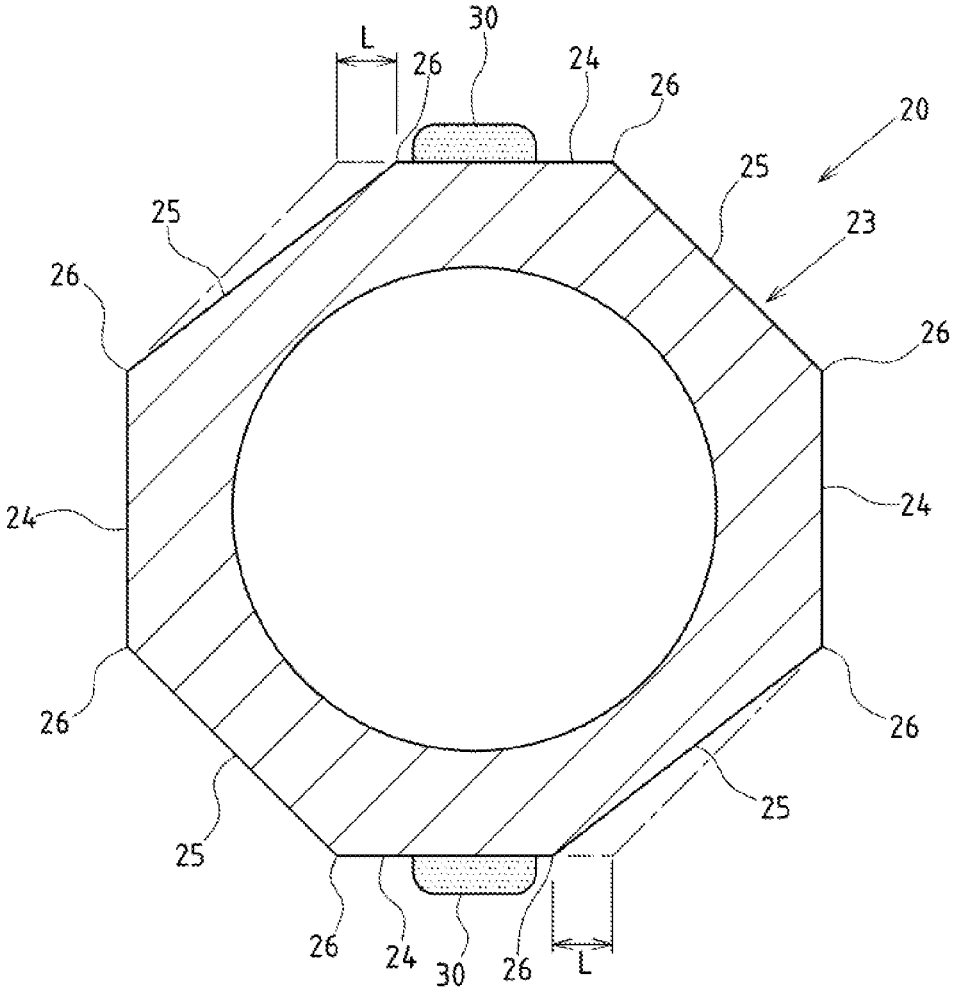
FIG. 3 is a sectional view of the sleeving column of the present invention.

FIGS. 1 to 3 depict preferred embodiments of the present invention, which, however, are provided for only explanatory objective for patent claims. Said tool retaining plate A is used for sleeving of the sleeve 01 in a rotary latch positioning state. The assembling end 02 of said sleeve 01 is provided with a square slot 03 to form four slot walls 04, and at least a positioning flange 05 is set at a certain depth of the slot wall 04.

The tool retaining plate A comprises a flaky disc base 10, consisting of a holding surface 11 and a mounting surface 12.

Several sets of sleeving columns 20 are configured at interval on the mounting surface 12 of the disc base 10. The sleeving columns 20 are of an octagonal columnar pattern to define a column head end 21, a column foot end 22 and a circumferential portion 23. Of which, four abutting surfaces 24 and four locking surfaces 25 are cross connected at the circumferential portion 23, and an angular locking portion 26 is formed between the abutting surface 24 and locking surface 25. Said locking portion 26 could generate a forced cross-locking action during rotation of the sleeve 01. Of which, the sleeving column 20 and disc base 10 are prefabricated, and the sleeving column 20 is either a solid column (shown in FIG. 9) or a hollow column. The sleeving column 20 penetrates downwards the holding surface 11 (shown in FIG. 7)

of the disc base 10 for easy prefabrication when it is a hollow column. The tool retaining plate A is made of plastics, so when the sleeving column 20 is extruded from the rotating sleeve 01, an instant elastic deformation can be generated for the forced cross-locking portion 26 (wherein the hollow column has a better effect than the solid one).

Figure 6:
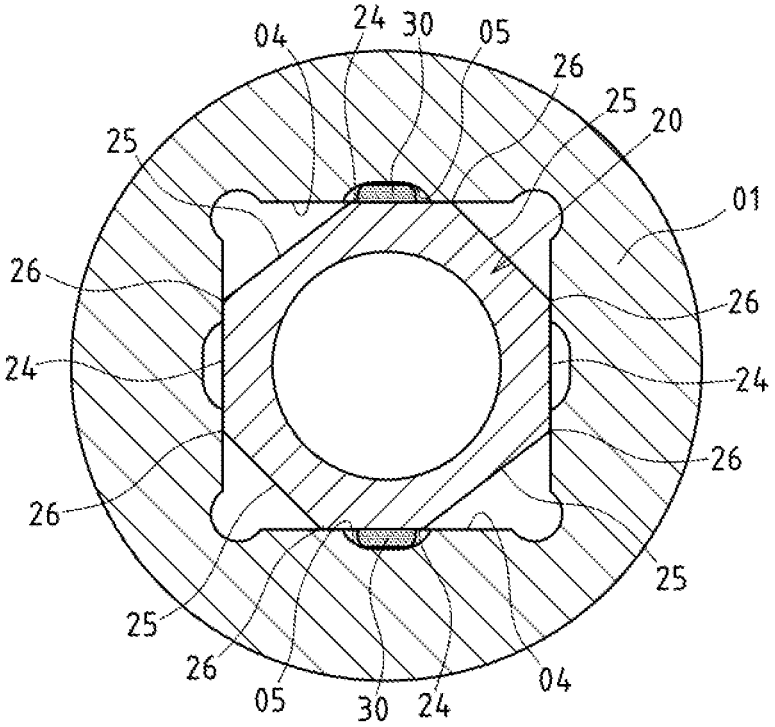
FIG. 6 is a sectional view of latching positioning of the sleeving column and the sleeve based on FIG. 5.

Positioning bulges 30 are protruded externally onto two opposite abutting surfaces 24 of the circumferential portion 23 of the sleeving column 20, opposite to the positioning flanges 05 of the sleeve 01. This enables engagement with the positioning flanges 05 on the slot wall 04 of the square slot 03 of the sleeve 01, permitting a latch positioning state of the sleeve 01 (shown in FIGS. 6 and 7).

Figure 4:
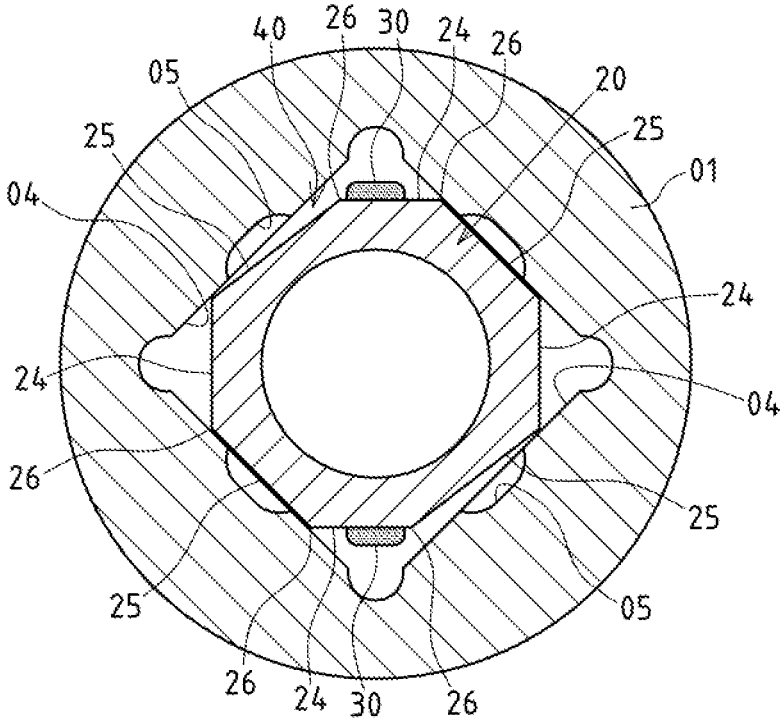
FIG. 4 is a sectional view of the combined sleeving column and sleeve.
Figure 5:
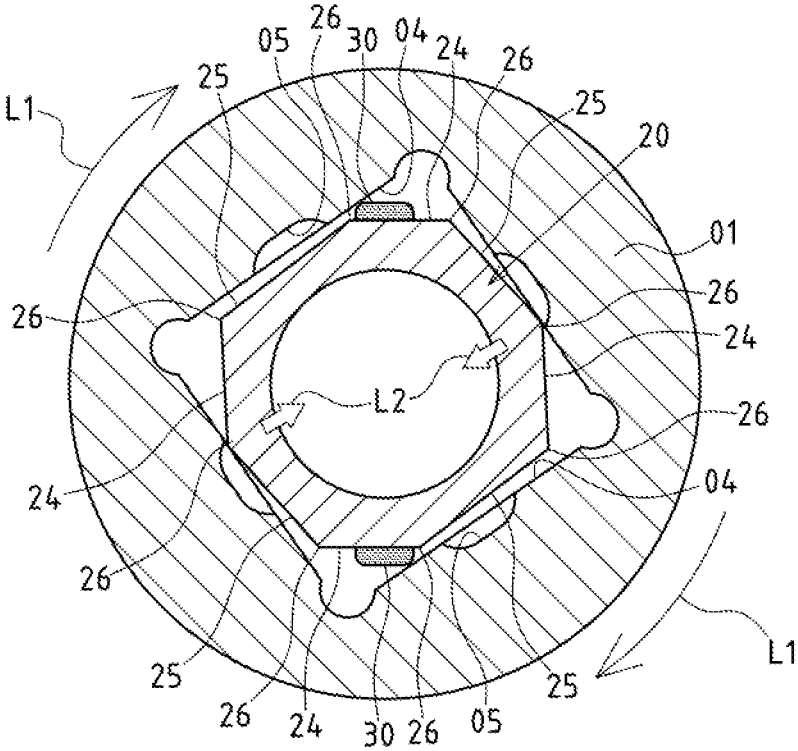
FIG. 5 is a rotary latching view of the sleeve based on FIG. 4.
Figure 8:
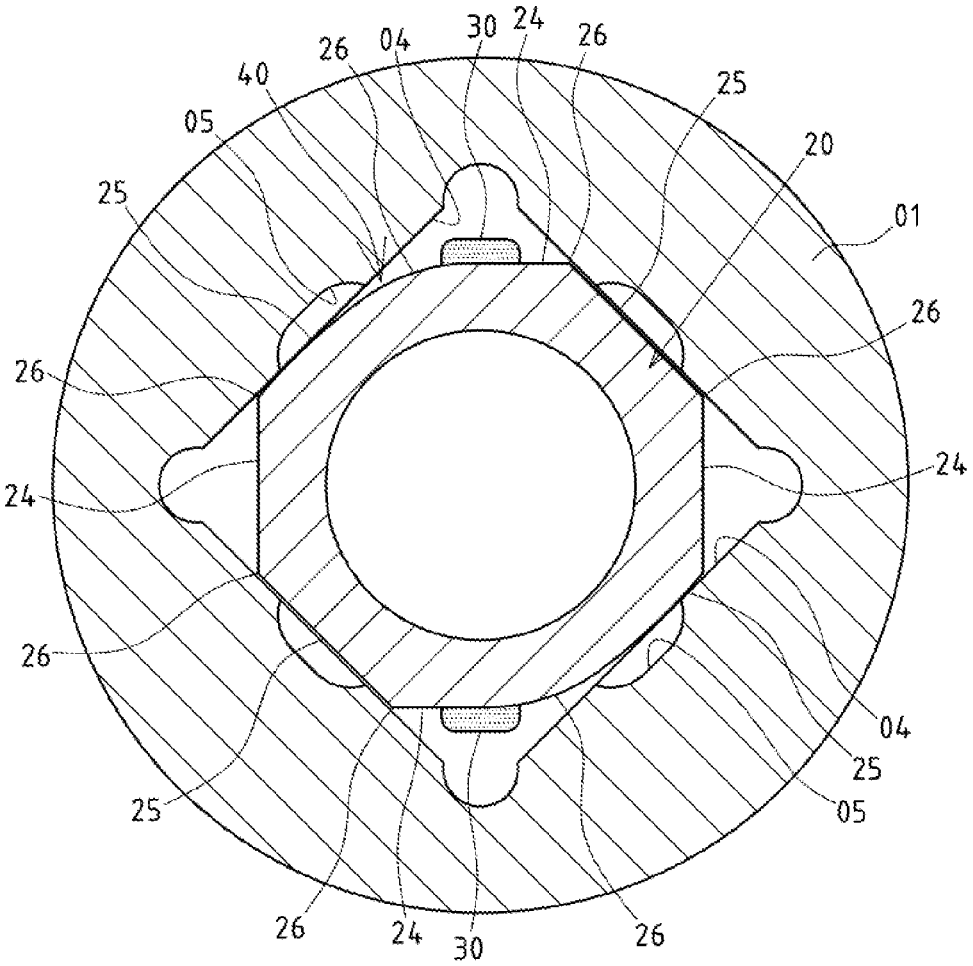
FIG. 8 is a sectional view of the present invention wherein two locking portions configured diagonally and set adjacent to the abutting surface with positioning bulges are set into a notched pattern.

Of which, two locking portions 26 configured diagonally and set adjacent to the abutting surface 24 with positioning bulges 30 are set into a notched pattern (shown in FIG. 8) or offset towards the abutting surface 24 (shown in FIG. 3). When the square slot 03 of the sleeve 01 is set outside the sleeving column 20, a crossing space 40 (shown in FIG. 4) is formed between the slot wall 04 of the sleeve 01 and the notched or offset locking portions 26. Referring to FIG. 3, the offset distance (shown as L in the figure) of said offset locking portion 26 towards the abutting surface 24 is between ⅕ and ⅓ of the width of the abutting surface 24. And, referring to FIG. 8, the notched locking portion 26 is formed by convex arc coupling of the adjacent abutting surface 24 and the locking surface 25. Next, the operation and functional advantages of the present invention are described as follows:

Referring to FIG. 4, when the sleeving column 20 is inserted into sleeve 01 but not yet rotated, the positioning bulge 27 is located correspondingly at the corner of the square slot 11, and two locking portions 26 configured diagonally and set adjacent to the abutting surface 24 with positioning bulges 30 are offset towards the abutting surface 24, a crossing space 40 is formed between the slot wall 04 of the sleeve 01 and the offset locking portion 26. Referring to FIG. 5, while the sleeve 01 is rotated (shown by arrow L1) to drive the positioning bulge 30 to engage with the positioning flange 05, the slot wall 04 of the square slot 11 is only abutted (shown by arrow L2) to another two locking portions 26, but not the offset locking portion 26, helping to reduce substantially the friction area and resistance, enabling easier and smooth rotation and locking of the sleeve 01 for improved structural strength of the sleeving column 20.

On the other hand, as compared with the prior art, the present invention provides a new tool retaining plate A for the rotary latch positioning sleeve 01, of which a relatively bigger matching error between the square slot 11 of the sleeve 01 and the sleeving column 20 is permissible to ensure simple construction and manufacturing without affecting the positioning stability of the sleeve 01. Moreover, this could improve the availability and combination strength, and also enhance the positioning stability and convenience of the sleeve 01.

Figure 7:
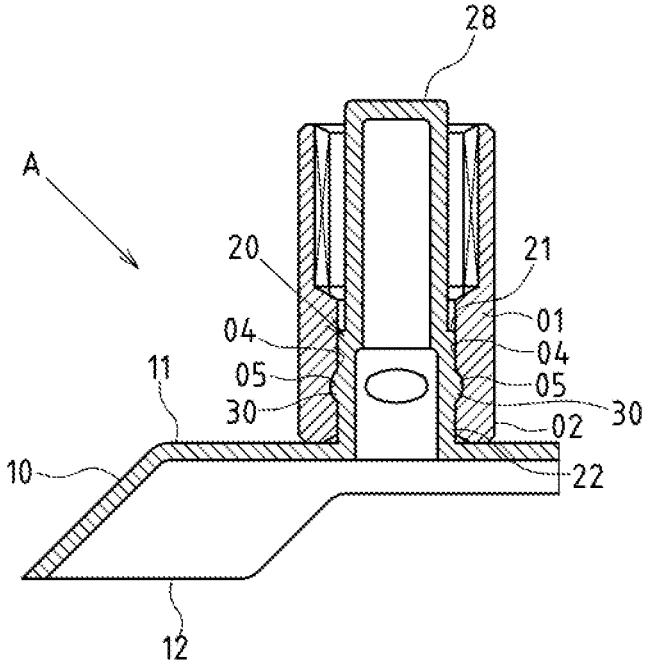
FIG. 7 is another lateral sectional view of latching positioning of the sleeving column and the sleeve based on FIG. 6.
Figure 9:
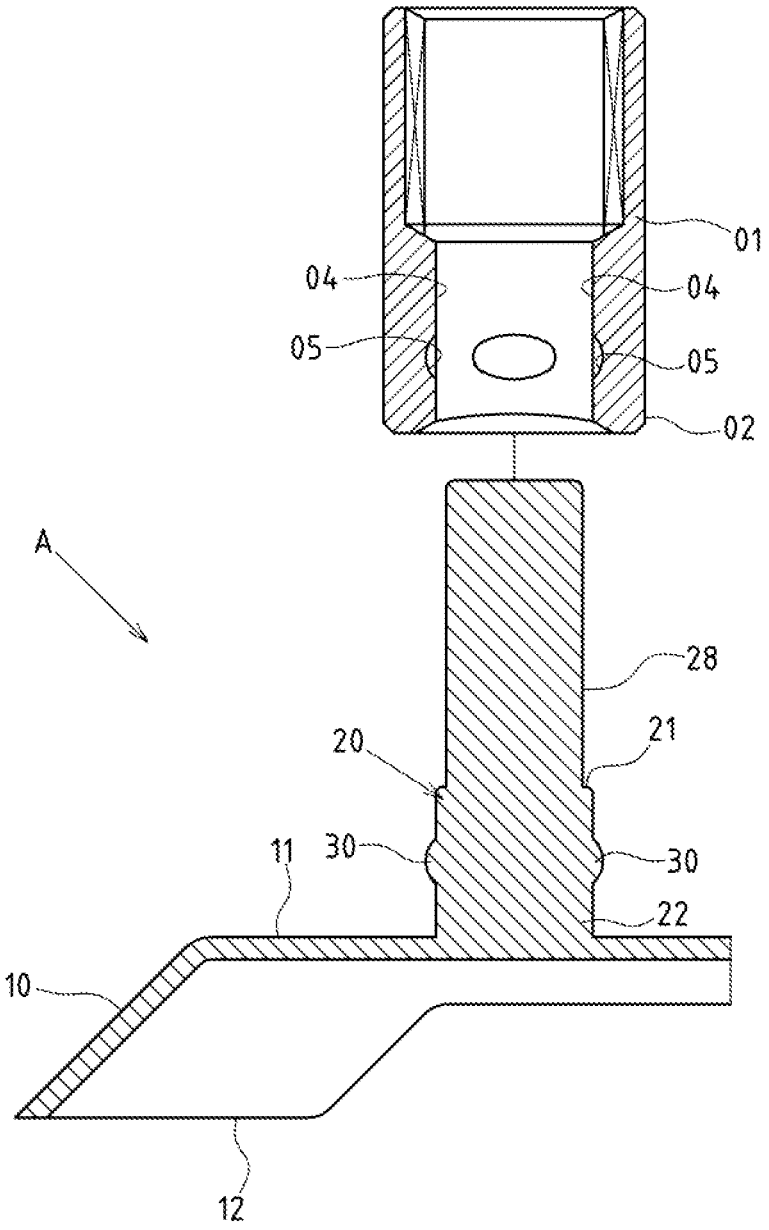
FIG. 9 is an application view of the present invention wherein the sleeving column is of a solid column.

Referring to FIGS. 7 and 9, an extension rod 28 can be connected to the top of the sleeving column 20, allowing to insert the sleeving column 20 into the sleeve 01 for better limitation of the wall of the sleeve 01.

I claim:

1. A tool retaining plate assembly for sleeving a sleeve in a rotary latch positioning state, the sleeve having an assembling end with a square slot defining four slot walls, the slot wall having a positioning flange extending to a depth from the slot wall, the tool retaining plate assembly comprising:

a disc base having a holding surface and a mounting surface;

a plurality of sleeving columns positioned in spaced relation to each other on said mounting surface, wherein each of said plurality of sleeving columns are of an octagonal columnar shape and define a column head end and a column foot and a circumferential portion, wherein four abutting surfaces and four locking surfaces are cross connected at said circumferential portion and an angular locking portion is formed between said abutting surface and said locking surface, said locking portion generating a cross-locking action during a rotation of the sleeve;

a plurality of positioning bulges protruding externally of a pair of the opposite abutting surfaces opposite to the positioning flanges of the sleeve, said plurality of positioning bulges suitable for engaging with the positioning flanges so as to cause a latch positioning state of the sleeve; and a pair of locking portions diagonally positioned adjacent to the abutting surface, said plurality of positioning bulges positioned toward the abutting surface, wherein a crossing space is formed between the slot wall of the sleeve and the pair of locking portions when the square slot of the sleeve is positioned outside the positioning column.

2. The tool retaining plate assembly of claim 1, wherein the locking portion is formed by a convex arc coupling of the adjacent abutting surface and the locking surface.

3. The tool retaining plate assembly of claim 1, wherein a distance of the locking portion and the abutting surface is between ⅕ and ⅓ of a width of the abutting surface.

4. The tool retaining plate assembly of claim 1, further comprising:

an extension rod connected to a top of the sleeving column.

5. The tool retaining plate assembly of claim 4, the sleeving column being a solid column.

6. The tool retaining plate assembly of claim 4, the sleeving column being a hollow column, wherein the sleeving column penetrates said holding surface of said disc base.

* * * * *